United States Patent [19]

Kishi et al.

[11] Patent Number: 4,494,512

[45] Date of Patent: Jan. 22, 1985

[54] METHOD OF CONTROLLING A FUEL SUPPLYING APPARATUS FOR INTERNAL COMBUSTION ENGINES

[75] Inventors: Noriyuki Kishi, Tokyo; Shumpei Hasagawa, Niiza, both of Japan

[73] Assignee: Honda Giken Kogyo Kabushiki Kaisha, Tokyo, Japan

[21] Appl. No.: 489,676

[22] Filed: Apr. 28, 1983

[30] Foreign Application Priority Data

Jun. 23, 1982 [JP] Japan ..... 57-107972

[51] Int. Cl.[3] ..... F02M 7/00

[52] U.S. Cl. ..... 123/489; 123/440

[58] Field of Search ..... 123/489, 440, 438, 480

[56] References Cited

U.S. PATENT DOCUMENTS

| | | | |
|---|---|---|---|
| 4,355,616 | 10/1982 | Tamura et al. | 123/489 |
| 4,359,029 | 11/1982 | Furuhashi et al. | 123/189 |
| 4,375,797 | 3/1983 | Otsuka et al. | 123/489 |
| 4,392,471 | 7/1983 | Miyagi et al. | 123/489 |
| 4,399,792 | 8/1983 | Otsuka et al. | 123/489 |

*Primary Examiner*—Raymond A. Nelli

*Attorney, Agent, or Firm*—Pollock, Vande Sande & Priddy

[57] ABSTRACT

A method of controlling a fuel supplying apparatus, particularly, an electronically controlled fuel injecting apparatus is provided, said apparatus having a feedback control function to regulate the air fuel ratio of air-fuel mixture to be supplied to an internal combustion engine on the basis of a fuel amount value representative of a fuel amount to be supplied to the engine, which value is calculated in response to an output signal of an oxygen concentration sensor provided in the exhaust system of the internal combustion engine. The fuel amount value is compared with a predetermined value. When the fuel amount is larger than the predetermined value, the feedback control for the air fuel ratio is stopped, thereby performing the open-loop control for the air fuel ratio, whereby, a simple arithmetic processing is obtained and the arithmetic time is shortened and the memory capacity can be saved.

4 Claims, 4 Drawing Figures

METHOD OF CONTROLLING A FUEL SUPPLYING APPARATUS FOR INTERNAL COMBUSTION ENGINES

FIELD OF THE INVENTION

The present invention relates to a method of controlling a fuel supplying apparatus incorporated with an internal combustion engine.

BACKGROUND OF THE INVENTION

There is known a method of controlling an adjustable fuel supply apparatus such as a fuel injector, a carburetor or the like to provide a proper fuel supply to an internal combustion engine. In such a fuel supply control method, an amount of fuel supply which is optimum in an operational state of the internal combustion engine is calculated on the basis of various engine parameters representative of operational conditions of the engine.

In the above-mentioned controlling method, a fundamental value representative of the fundamental fuel supply amount is calculated on the basis of the fundamental engine parameters such as the engine rotating speed, the amount of intake air, and so on. The correction coefficient for increase or reduction of the fundamental value is calculated on the basis of the additional engine parameters such as a temperature of the cooling water in the engine, or the transient operational change of engine. A final value representative of a desired fuel supply amount is obtained by multiplying the above-mentioned fundamental value by the above-stated correction coefficient.

In case of a specific operational state of the engine, for example, at a low temperature state of the cooling water or at a high output power state or the like, instead of the feedback control for the theoretical air fuel ratio an air fuel ratio control has to be performed in the open-loop state in the controlling method of the prior-art described above. Whether or not an instantaneous state of the engine requires the open-loop control is determined on the basis of the detected parameters such as the fundamental fuel amount and the cooling water temperature, etc. in a known manner. Moreover, other corrections for increase of the fuel amount are necessary in a specific operational state; thus, it must be determined whether or not the open-loop control is necessary on the basis of those correction coefficients.

As described above, in the prior-art method, a complicated processing is required for discrimination of the necessary of open-loop control. Particularly, for the control using a digital computer, it takes a relatively long time period to complete the aforementioned processing, so that it has been difficult to perform a quick and accurate discrimination.

SUMMARY OF THE INVENTION

The present invention therefore intends to provide a method of controlling a fuel supplying apparatus in which there is no need to discriminate the necessity of open-loop control by the individual processings, while paying attention to the fact that the output result of the arithmetic processing, namely, the final fuel supply amount is calculated on the basis of the above-described fundamental fuel amount and the various corrections for increase of fuel amount depending upon the temperature of the cooling water, etc.

In a method of controlling a fuel supplying apparatus according to the present invention, it is detected that a calculated whole amount of fuel to be supplied to the engine is larger than a predetermined amount, and in that case, the feedback control for the air fuel ratio is stopped, thereby performing the open-loop control for the air fuel ratio wherein the fuel supply amount is controlled without respect to the air-fuel ratio in the exhaust gases.

Other features and advantages of the invention will become apparent from the following description of an embodiment while referring to the drawing, which shows the details essential to the invention, and from the claims.

DETAILED DESCRIPTION OF A PREFERRED EMBODIMENT

Figure 1:
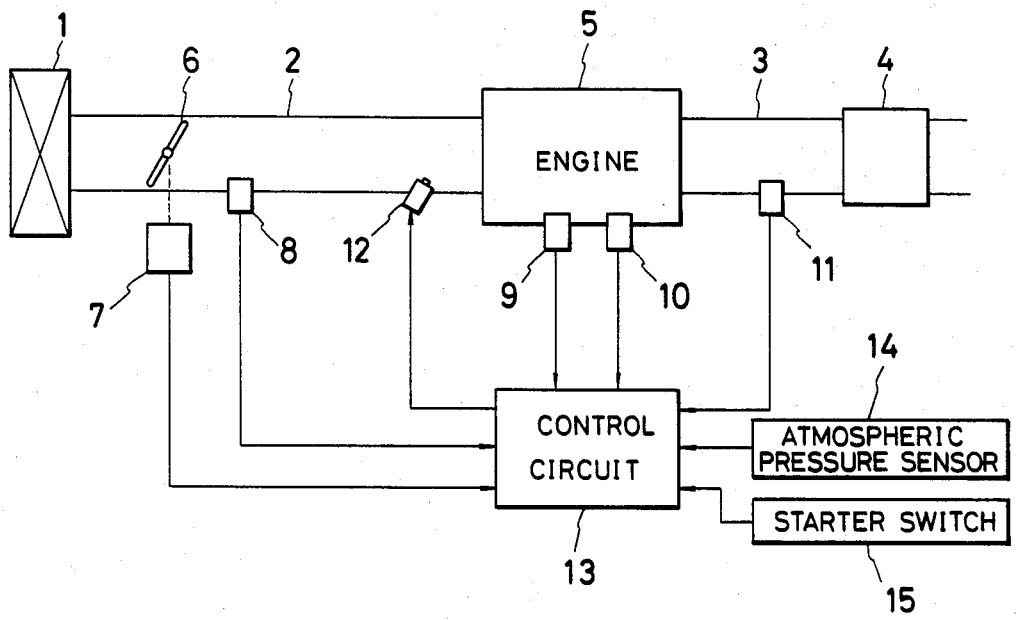
FIG. 1 is a block diagram showing an electronically controlled fuel supplying apparatus incorporated in an internal combustion engine, to which apparatus a controlling method according to the present invention is applied.

Referring to FIG. 1, reference numeral 1 shows an air cleaner, 2 indicates an intake pipe, 3 denotes an exhaust pipe, and 4 denotes a catalytic converter. The suction air is supplied from the air cleaner 1 through the intake pipe 2 to an engine 5, and the amount of suction air flowing through the intake pipe 2 is controlled by a throttle valve 6 provided within the intake pipe 2. The throttle valve 6 is provided with a throttle opening angle sensor 7, for example, a potentiometer which generates an output voltage of a level in response to the opening angle of the throttle valve 6. The intake pipe 2 is provided with an intake absolute pressure sensor 8 which generates an output voltage of a level in response to the intake pressure of the suction air flowing along the intake pipe 2. The engine 5 is provided with a cooling water temperature sensor 9 and a crack angle sensor 10. The sensor 9 generates an output voltage of a level in response to the temperature of the cooling water for the engine 5. The sensor 10 generates a pulse signal when a crank shaft (not shown) of the engine 5 is at a predetermined turning angle. An oxygen concentration sensor 11 which generates an output voltage of a level in response to the concentration of oxygen gas in the exhaust gases is provided within the exhaust pipe 3. An injector 12 is further provided within the intake pipe 2 near an intake valve (not shown) of the engine 5, and serves to inject fuel amount in response to a time period of an input voltage to supply the fuel to the engine 5. Each output terminal of the throttle opening angle sensor 7, intake absolute pressure sensor 8, cooling water temperature sensor 9, crank angle sensor 10, and oxygen concentration sensor 11, and the input terminal of the injector 12 are connected to a control circuit 13. An atmospheric pressure sensor 14 and a starter switch 15 are also connected to the control circuit 13. The starter switch 15 is used to turn ON and OFF the voltage supply to a starting motor (not shown) of the engine 5.

When this switch 15 is turned ON, the voltage is supplied to both the starter motor and the control circuit 13.

Figure 2:
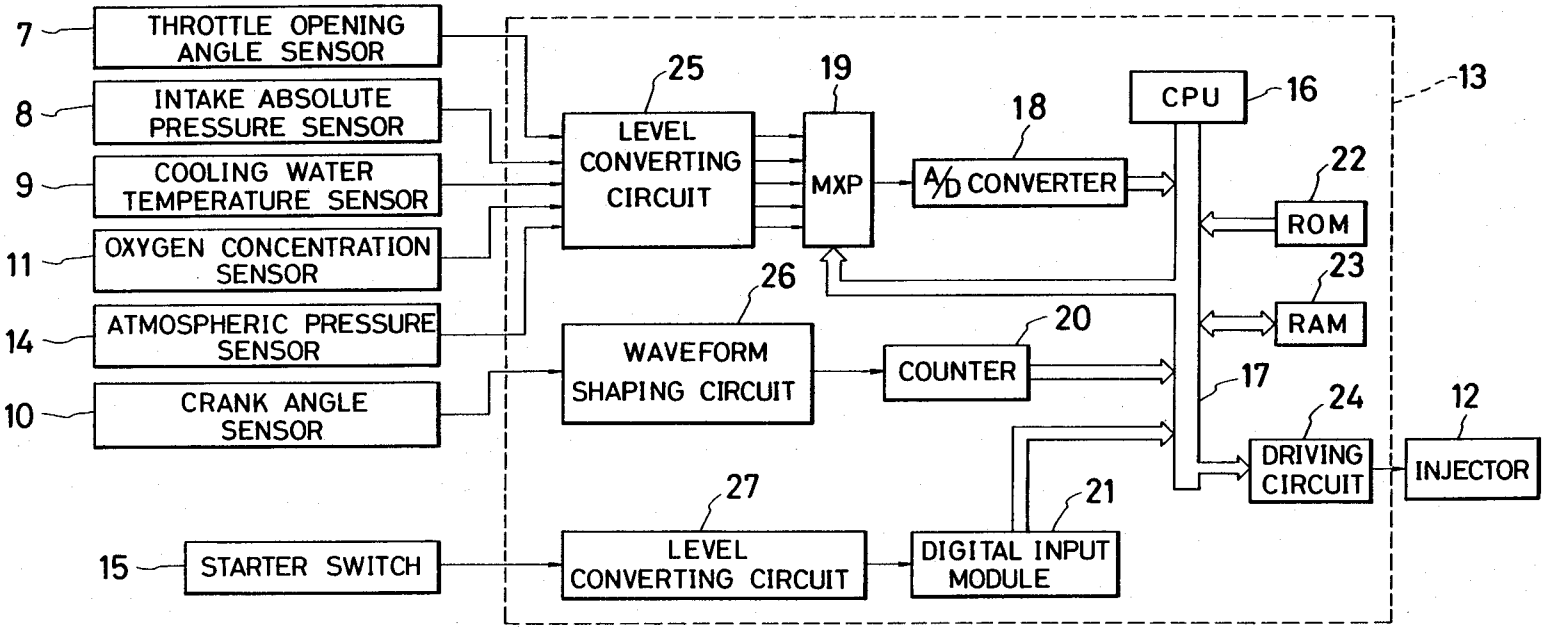
FIG. 2 is a schematic block diagram of the control circuit of FIG. 1.

FIG. 2 shows a specific circuit arrangement of the control circuit 13, in which the control circuit 13 includes a CPU (central processing unit) 16 which performs the digital arithmetic operation according to a program. An input/output bus 17 is connected to the CPU 16 and data signals or address signals are input into and output from the CPU 16 through the input/output bus 17. An A/D (analog/digital) converter 18, an MPX (multiplexer) 19, a counter 20, a digital input module 21, a ROM (read only memory) 22, a RAM (random access memory) 23, and a driving circuit 24 for the injector 12 are connected to the input/output bus 17, respectively. Each of the output signals from the sensors 17 to 11, and 14 are supplied to the MPX 19 through a level converting circuit 25. The MPX 19 then selects one of the above-mentioned output signals in response to a command from the CPU 16 and supplies to the A/D converter 18. The counter 20 is connected through a wave form shaping circuit 26 to the output terminal of the crank angle sensor 10 and measures the generating period of the output pulses of the crank angle sensor 10. The digital input module 21 is connected through a level converting circuit 27 to the starter switch 15 and generates a predetermined digital signal when the starter switch 15 is turned ON.

In the construction mentioned above, various pieces of information representing the throttle opening angle, intake pressure, cooling water temperature, oxygen concentration, and atmospheric pressure are selectively supplied from the A/D converter 18 through the input/output bus to the CPU 16. The information indicative of the engine rotating speed from the counter 20 and the ON/OFF information of the starter switch 15 from the digital input module 21 are also supplied through the bus 17 to the CPU 16, respectively. The arithmetic programs for the CPU 16 have been preliminarily stored in the ROM 22. The CPU 16 reads each piece of the above-mentioned information in accordance with these arithmetic programs and calculates the fuel injection time $T_{OUT}$ corresponding to the amount of fuel supply per each of predetermined rotations of the engine 5 or at predetermined sampling timings defined by clock pulses while using the calculating expression which will be described later on the basis of those pieces of information. The driving circuit 24 makes the injector 12 operative for only the fuel injection time $T_{OUT}$ thus obtained, thereby supplying the fuel to the engine 5.

The above-mentioned fuel injection time $T_{OUT}$ is, for example, obtained from the following expression in the fundamental mode, after the cranking period of the engine.

$$T_{OUT}=T_i\times(K_{PA}\times K_{TW}\times K_{AST}\times K_{AFC}\times K_{WOT}\times K_{O2}\times K_{LS})+T_{ACC}\times(K_{TA}\times K_{PA}\times K_{TWT}\times K_{TAST})+T_V \quad (1)$$

Wherein, $T_i$: fundamental fuel injection period corresponding to the fundamental fuel supply amount which is determined by the engine rotational speed and the intake pressure, $T_{ACC}$: increase amount value at the time of acceleration $T_V$: correction value of the voltage applied to the injector, $K_{PA}$: atmospheric pressure coefficient, $K_{TW}$: cooling water temperature coefficient, $K_{AST}$: increase amount coefficient just after the engine cranking period, $K_{AFC}$: increase amount coefficient just after the fuel cut off ceases, $K_{WOT}$: coefficient to make the air fuel ratio rich when the throttle valve 6 is fully opened, $K_{O2}$: feedback correction coefficient of the air fuel ratio, $K_{LS}$: coefficient to make the air fuel ratio lean, $K_{TWT}$: cooling water temperature coefficient at the time of acceleration, $K_{TAST}$: increase amount coefficient just after the engine cranking period at the time of acceleration.

The correction coefficients such as the increase amount value $T_{ACC}$, $K_{PA}$, etc. are calculated in the subroutine of the fundamental mode calculation routine for the fuel injection time $T_{OUT}$, respectively. More than two correction coefficients are simultaneously obtained in dependence upon the operational state of the engine 5.

Figure 3:
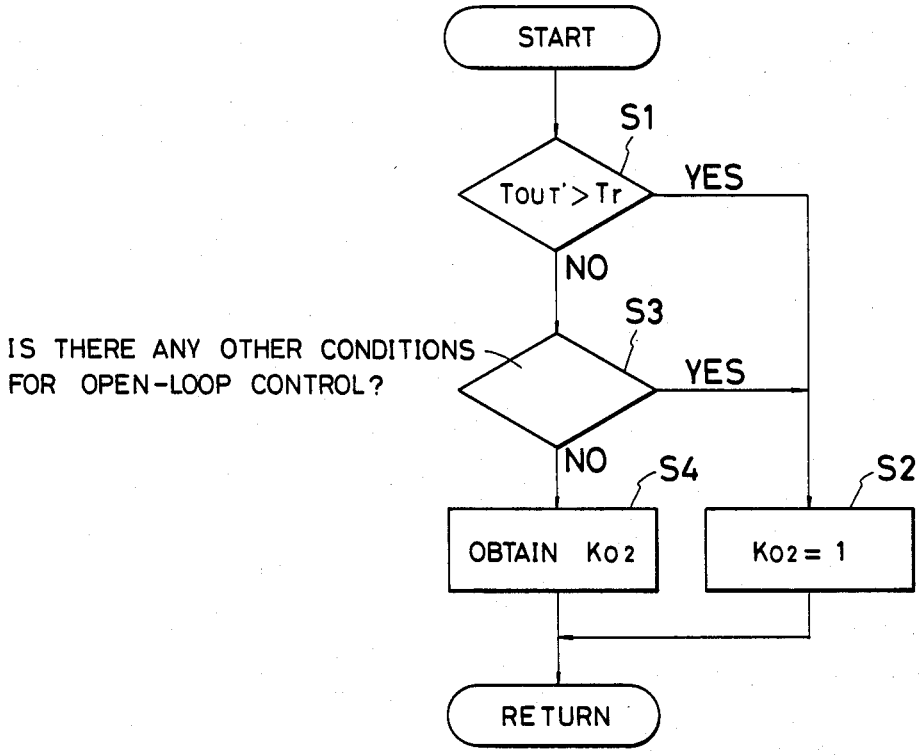
FIG. 3 is a flow chart showing the operation of the control circuit for describing the controlling method according to the present invention.

FIG. 3 shows an operating flow chart of the present invention. The subroutine shown in the flow chart is started at each timing which synchronizes with the rotation of the engine or is defined by clock pulses.

Figure 4:
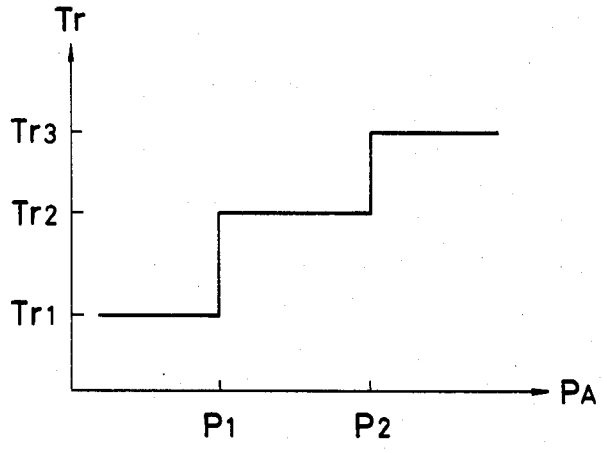
FIG. 4 is a graph showing the characteristic of changes of a predetermined value appearing in the flow chart of FIG. 3.

As shown in FIG. 3, the control circuit 13 firstly compares the fuel injection time $T'_{OUT}$ obtained at the preceding timing with a predetermined value $T_r$ (in step S1). The predetermined value $T_r$ changes dependently upon the magnitude of atmospheric pressure $P_A$ and it increases step by step as the atmospheric pressure $P_A$ increases as shown in FIG. 4. If YES in step S1, namely, when $T'_{OUT}>T_r$, the feedback coefficient $K_{O2}$ is set to "1" and the air fuel ratio is controlled as the open loop (step S2). If NO in step S1, namely, when $T'_{OUT}\leqq T_r$, the processing advances to step S3, where the driving state is checked to determine whether it requires the other open-loop controls or not. In case of the operational state in which the open-loop controls such as the cut-off of fuel, the idling of engine, or the like is required, step S2 follows. When the open-loop control is not required, a feedback coefficient $K_{O2}$ is calculated to perform the feedback control of the air fuel ratio (step S4).

The feedback control for the air fuel ratio is performed by discriminating the air fuel ratio of the exhaust gases on the basis of the information on oxygen concentration in the exhaust gases whereby the air fuel ratio is regulated around a theoretical air fuel ratio so as to determine the feedback coefficient $K_{O2}$ so that the air fuel ratio of the intake gases is made lean when the exhaust air fuel ratio is determined to be rich and the intake air fuel ratio is made rich when the exhaust air fuel ratio is determined to be lean.

With respect to an engine having an auxiliary combustion chamber connected to a main combustion chamber through at least one torch nozzle, the air fuel ratio for the auxiliary chamber is essentially set so as to be a firing source of the compressed mixture gas in the main chamber, and the value of air fuel ratio is set in accordance with the output request of the engine principally on the main chamber side. Hence, the fuel supply in the main chamber side must to be controlled on the basis of more control factors than those in the auxiliary chamber side supplied with the fuel by an injector or a carburetor. Therefore, the aforementioned various increase amount coefficients are adopted in the arithmetic expression for the fuel supply to the main chamber side. From the viewpoint described above, in the engine having an auxiliary chamber, it is desirable to discriminate whether the open-loop control is necessary or not in accordance with the fuel amount to be supplied to the main chamber.

As described above, in the method of controlling a fuel supplying apparatus for internal combustion engines according to the present invention, when the fuel supply amount calculated at a preceding timing is larger than a predetermined amount, then the feedback control for the air fuel ratio is stopped at present timing, thereby performing the open-loop control. Therefore, there is no need to discriminate and detect various cases wherein the open-loop control is to be performed, for example, the cases where the operational state of the engine is in a high output power state or a low temperature of cooling water state or the like; or the cases where the increase amount correction coefficient is relatively large.

Furthermore, in the event that the multiplied value of the fundamental supply amount and each correction coefficient exceeds a predetermined level, the open-loop control is started; consequently, the arithmetic processing becomes simple and the arithmetic time period is shortened, and the memory capacity can be saved.

What is claimed is:

1. In a method of supplying fuel to an internal combustion engine provided with an oxygen concentration sensor at the exhaust system thereof, said oxygen concentration sensor being adapted to produce an oxygen concentration signal representative of the oxygen concentration in the exhaust gases flowing through the exhaust system, which method cyclically performs the steps of calculating an instantaneous fundamental fuel amount value in accordance with the engine speed and load, calculating an oxygen concentration correction coefficient in accordance with said oxygen concentration signal and at least two additional correction values in accordance with at least two engine parameters other than the oxygen concentration, modifying said fundamental fuel amount value by said oxygen concentration correction coefficient and said additional correction value so as to obtain fuel amount value, and supplying fuel of an amount corresponding to said final fuel amount value to the engine, the improvement which comprises:

a first step of discriminating that said final fuel amount value exceeds a predetermined level at a cycle; and a second step of fixing said oxygen concentration coefficient at a predetermined value without respect to said oxygen concentration signal.

2. A controlling method as claimed in claim 1, wherein said predetermined value varies in dependence upon the magnitude of the atmospheric pressure.

3. The method as claimed in claim 1, wherein said fuel supplying is effected by a fuel injecting apparatus and the discrimination is made by comparing a fuel injection time period with a predetermined time period.

4. In a method of supplying fuel to an internal combustion engine having main and auxiliary chambers connected via torch nozzle means with each other and provided with an oxygen concentration sensor at an exhaust system thereof, said oxygen concentration sensor being adapted to produce an oxygen concentration signal representative of the oxygen concentration in the exhaust gases flowing through the exhaust system, which method cyclically performs the steps of calculating an instantaneous fundamental fuel amount value in accordance with engine speed and load, calculating an oxygen concentration correction coefficient in accordance with said oxygen concentration signal and at least two additional correction values in accordance with at least two engine parameters other than the oxygen concentration, modifying said fundamental fuel amount value by said oxygen concentration correction coefficient and said additional correction value so as to obtain final fuel amount value, and supplying fuel of an amount corresponding to said fuel amount value via a fuel injection valve to at least the main combustion chamber, the improvement which comprises:

a first step of discriminating that said final fuel amount value exceeds a predetermined level at one cycle; and a second step of fixing said oxygen concentration coefficient at a predetermined value without respect to said oxygen concentration signal.

* * * * *